United States Patent [19]

Rockwell

[11] Patent Number: 4,691,918

[45] Date of Patent: Sep. 8, 1987

[54] MULTIPLE EXERCISE DEVICE

[75] Inventor: Gary L. Rockwell, LaGrange, Ga.

[73] Assignee: Diversified Products Corporation, Opelika, Ala.

[21] Appl. No.: 785,440

[22] Filed: Oct. 8, 1985

[51] Int. Cl.[4] ..... A63B 21/00

[52] U.S. Cl. ..... 272/134; 272/144

[58] Field of Search ..... 272/117, 118, 123, 134, 272/144, 93, 136; 108/12, 138; 297/338; 128/70-74; 5/62, 63

[56] References Cited

U.S. PATENT DOCUMENTS

| | | | |
|---|---|---|---|
| 321,388 | 6/1885 | Ruebsam | 272/134 |
| 1,902,694 | 3/1933 | Edwards | 272/134 |
| 2,648,540 | 8/1953 | Hunter | 272/118 |
| 2,831,687 | 4/1958 | Hunter | 272/145 |
| 2,855,200 | 10/1958 | Blickman . | |
| 3,709,487 | 1/1973 | Walker . | |
| 4,072,309 | 2/1978 | Wilson | 272/136 |
| 4,140,312 | 2/1979 | Buchmann . | |
| 4,275,882 | 6/1981 | Grosser et al. . | |
| 4,319,747 | 3/1982 | Rogers . | |
| 4,358,109 | 11/1982 | Schrems . | |
| 4,369,966 | 1/1983 | Silberman et al. . | |
| 4,492,375 | 1/1985 | Connelly | 272/134 |
| 4,521,013 | 6/1985 | Dofel . | |
| 4,546,967 | 10/1985 | Kecala | 272/144 |
| 4,576,377 | 3/1986 | Wolff | 272/134 X |

FOREIGN PATENT DOCUMENTS

| | | |
|---|---|---|
| 2158362 | 11/1985 | United Kingdom . |

*Primary Examiner*—Richard J. Apley
*Assistant Examiner*—J. Welsh
*Attorney, Agent, or Firm*—Banner, Birch, McKie & Beckett

[57] ABSTRACT

A floor-supported multiple exercise device having an adjustable bench assembly and a user-engageable pulley system. The adjustable bench assembly is pivotable between a first raised position, a second, lowered position proximate its base, and a third declined position. The pulley system allows the resistance to be moved directly or indirectly. When moved indirectly, the pulley system employs a traveling pulley assembly.

16 Claims, 8 Drawing Figures

MULTIPLE EXERCISE DEVICE

BACKGROUND OF THE INVENTION

The present invention relates to exercise devices for developing and conditioning various parts of the body and, more particuarly, to a floor-supported, multiple exercise, variable resistance exercise device.

The importance of regular exercise for building and maintaining muscular strength and endurance cannot be over emphasized. The modern conveniences which we enjoy and the sedentary tasks which we increasing perform having given us a comfortable lifestyle at the expense of physical fitness. Highly active exercise programs, such as running, are useful for developing the cardiovascular system and limited muscle groups. Overall muscle strength and endurance, however, is best developed through weight or resistance training.

The simplest and least expensive apparatus for resistance training is the barbell with removable weights. However, the use of the barbell alone cannot develop all areas of the body. Hence, additional apparatus must be employed for a comprehensive conditioning program. Exercise apparatus developed for this purpose generally provide the user with a resistance element against which muscular effort must be applied. Resistance is typically provided by a weight and pulley arrangement, an elastic element, an electromagnetic device, a pneumatic device, or other known variable resistance devices. Typically, known prior art exercising apparatus permit the user's to perform many different exercises in order to develop substantially all areas of the body. However, the weight training devices which provide the user with substantially all of the exercising variants required to develop the entire body are generally large, complex and costly machines which occupy a substantial amount of space, and consequently are not suitable for home or personal use. These are usually found only in health clubs and other athletic establishments. Devices specifically designed for home use, while somewhat smaller, have not provided the necessary and desired wide variety of exercise options. Hence a need exists for a compact and versatile exercise unit suitable for home or personal use.

SUMMARY OF THE INVENTION

It is an object of the present invention to obviate the above-noted disadvantages of the prior art by providing a simple, compact and inexpensive exercising apparatus for performing a compact range of weight training exercises.

Another object of the invention is to provide such an apparatus which can be used to perform a full range of exercises in a minimum amount of space.

Another object of the invention is to provide such an apparatus which has a pivotable and adjustable bench assembly to provide for a wide variety of exercising positions.

Another object of the invention is to provide such an apparatus with a user engageable pulley system which can be selectively engaged to allow the user to select a configuration suitable to a particular exercise.

These and other objects of the invention are accomplished by providing a floor-mounted multiple exercise device having a floor-supported base having a platform. A variable resistance assembly, such as weights, elastic elements, or an electromagnetic or penumatic resistance, is provided for allowing a user to vary the resistance of a particular exercise. In a preferred form of the invention, an electromagnetic resistance element is used to provide a more compact, lighter weight, quieter exercise device.

The adjustable bench assembly of the present invention is fixed to the base and provides a support for the user of the exercise device. The adjustable bench has adjustable bench support means for selective setting the position of the bench between at least three distinct positions. In a first, raised position the bench is parallel to and raised above the floor-supported base. In a second, lowered position the bench is lowered so that it is parallel to and proximate to the base member. In a third, declined position the bench is angled forwardly with respect to the base.

Preferably, the front end of the bench is fixed to an upstanding front support adjacent the front end of the platform when the bench is in the first, raised position. The front end of the bench is fixed to the base adjacent the platform when the bench is in the second, lowered position or the third, declined position.

The back end of the bench member is pivotally connected to the base by a support leg to allow the bench to assume its various positions. One end of the support leg is pivotally connected to the back end of the bench. The other end of the support leg is pivotally connected to the base adjacent the back end of the platform. Additionally, the bench cushion is pivotally hinged to the bench frame to allow the bench cushion to be angled upwardly with respect to the bench frame.

The adjustable bench support may also comprise a support foot fixed to the back end of the bench. The support foot is adapted to engage the floor and provide additional support when the bench is proximate to the base, i.e, in its second, lowered position. When the bench is raised above the base or angled with respect to the base, the support foot is spaced above the floor. In this configuration, the support foot may also function as an accessory holder for allowing the exercise device of the present invention to perform an even wider range of exercises.

An extensible and retractable load cable is fixed to the variable resistance means. The load cable emanates from the variable resistance means adjacent the front end of the platform. A pulley guide extends across the platform between the front and back ends of the platform.

Preferably, a user-engageable cable system is provided. The cable system comprises a traveling pulley assembly selectively connectable to the load cable. The travelling pulley is longitudinally slidable within the pulley guide.

An exercise cable is trained around the travelling pulley and extends through the pulley guide toward the back of the platform. Cable guide means are provided for guiding the exercise cable from the platform upwardly on both sides of the bench. At least one user-engageable handle may be selectively attached to either or both ends of the exercise cable on the sides of the bench or to the load cable. When attached to the exercise cable, the travelling pulley is connected to the load cable, whereby, upon exercising and movement of the handle, the exercise cable, travelling pulley, and load cable are moved together against the exercise resistance. When the handle is connected directly to the load cables, the exercise cable and travelling pulley are not operable.

An attachment element is provided on the traveling pulley assembly for attaching the load cable to the traveling pulley assembly thus allowing the user the ability to select a configuaration of the exercise device suitable to a particular exercise. For example, the user may attach an exercise bar or similar device directly to the load cable to perform one set of exercises, such as a rowing type exercise. Alternatively, the user may attach a user-engageable bar or similar device to the ends of the exercise cable and attach the travelling pulley to the load cable for performing different exercises, such as a bench press. By selecting the appropriate position of the bench and selecting whether the user moves the resistance directly by the load cable or indirectly by attaching the traveling pulley to the load cable and lifting the exercise cable, a comprehensive exercise program can be designed with exericses which work all the major muscle groups.

In a preferred form of the invention, the traveling pulley assembly includes a plurality of guide pads adapted to engage the pulley guide in the base, thus facilitating longitudinal sliding of the first pulley assembly. Also, it is preferred that the cable guide means include two guide pulley assemblies fixed to the base. The guide pulley assemblies are preferably longitudinally spaced from the travelling pulley assembly and fixed to the back of the base, one on each side of the pulley guide. A second guide pulley assembly is fixed to the base and longitudinally positioned between the traveling pulley assembly and the second guide pulley assemblies and laterally spaced from the pulley guide in the base. Additionally, vertically oriented guide pulleys are fixed to the base and positioned laterally outwardly of said second guide pulleys. The exercise cable is trained from the traveling pulley assembly to the guide pulley assemblies to the second guide pulley assemblies to the vertically oriented pulleys, with the ends of the exercise cable extending upwardly above the base. This arrangement provides a smooth and effective transfer of force from the ends of the exercise cable to the various resistance element when the exercise cable is fixed to the load cable.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

DETAILED DESCRIPTION OF THE PREFERRED EMBODIMENTS

Figure 1:
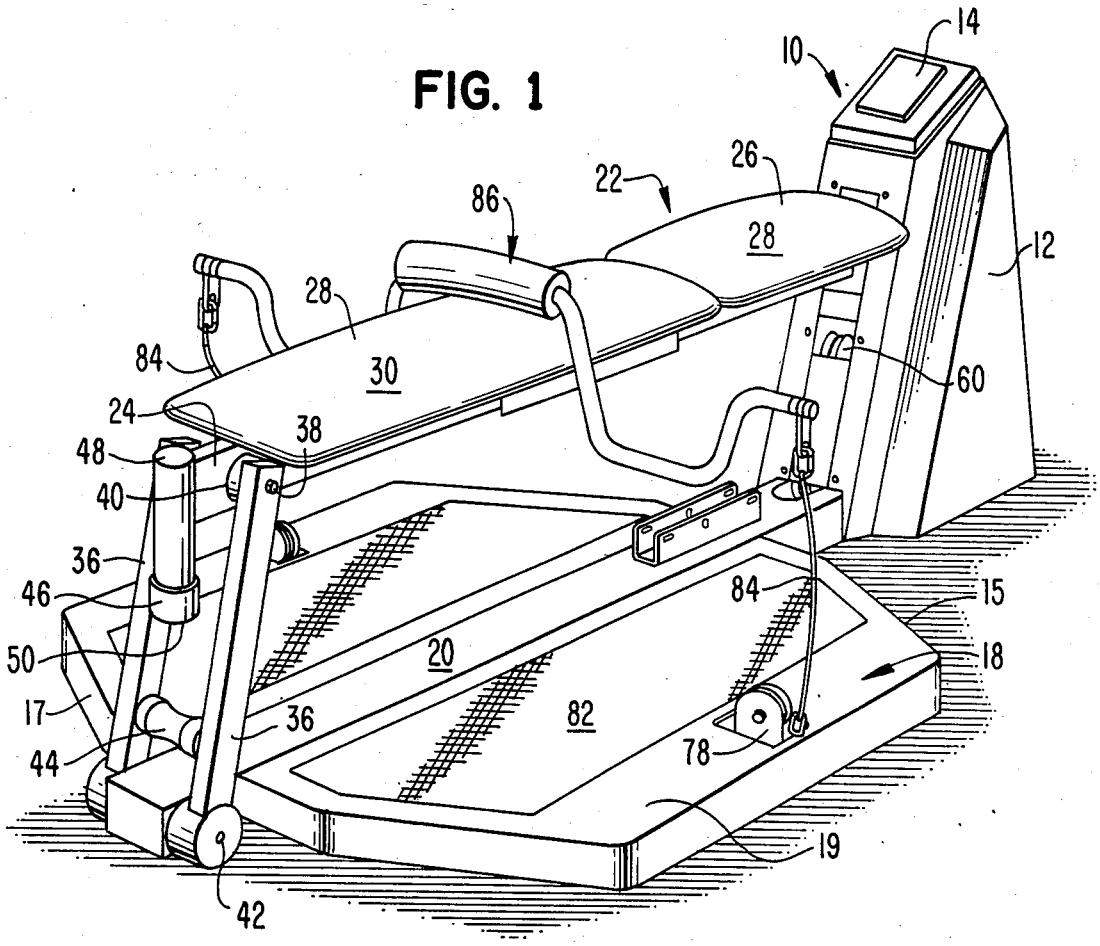
FIG. 1 is a perspective view of the exercise device according to the invention.

As shown in FIG. 1, the present invention includes a variable resistance device shown generally at 10. Variable resistance device 10 is preferably an electromagnetic device, which is preferred because of its compact design, light weight and quiet operation. However, variable resistance device 10 may include a stack of weights, elastic resistance elements, pneumatic resistance, or any other variable resistance device. Variable resistance device 10 in enclosed within a shroud or casing 12. A control panel 14 may be provided for controlling or varying the resistance of variable resistance device 10. Control panel 14 may also include a timer or counter (not shown), as is well known in the art.

Figure 3:
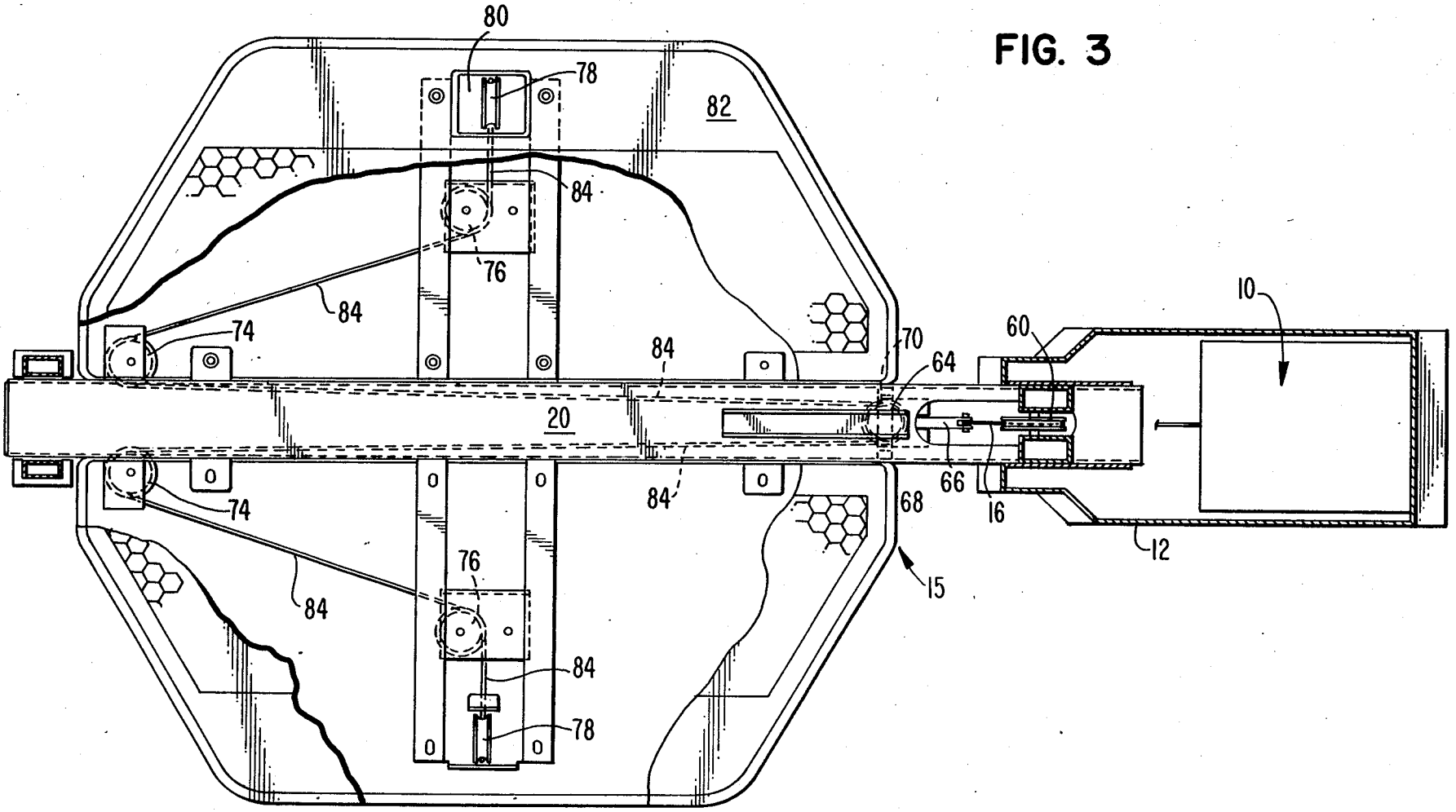
FIG. 3 is a partially cut away sectional view along line 3—3 of FIG. 2.
Figure 4:
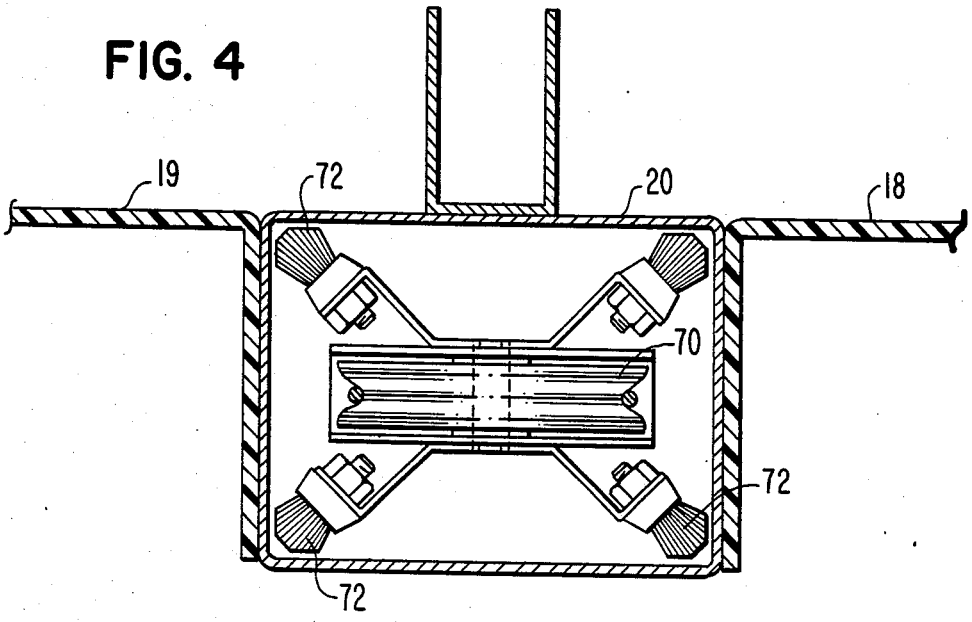
FIG. 4 is a sectional view along line 4—4 of FIG. 2.
Figure 5:
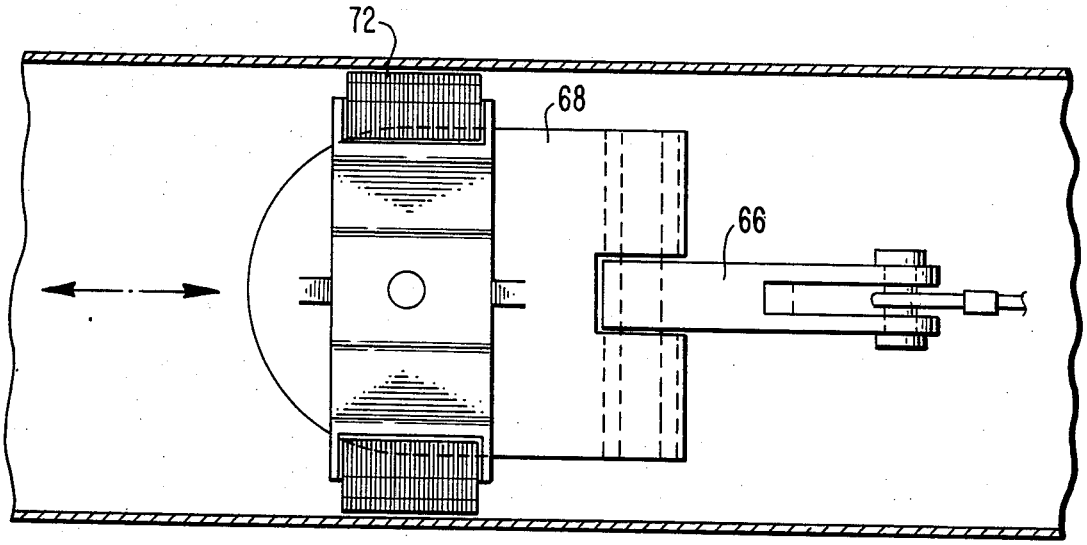
FIG. 5 is a top plan view of the traveling pulley assembly of the present invention.
Figure 6:
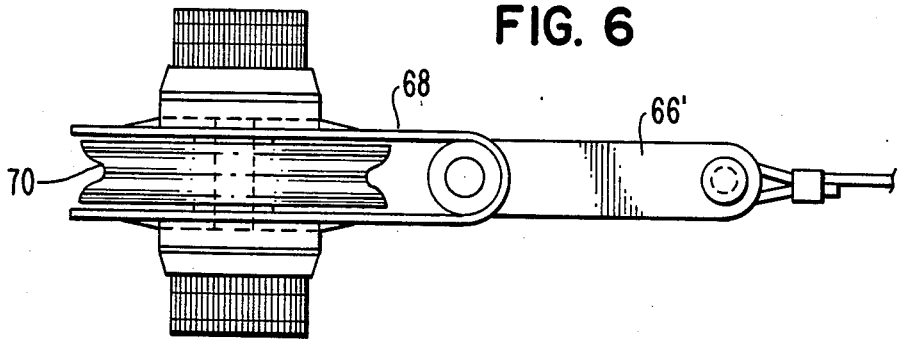
FIG. 6 is a side plan view of the traveling pulley assembly of the present invention.

A load cable 16, shown in FIG. 3, is connected to variable resistance device 10 and allows the user to exercise against the resistance selected.

As shown particularly in FIGS. 1 and 3, a large, floor supported base 18 is provided. As shown, base 18 is preferably a large planar member including a platform 19. Base 18 provides a firm and stable support for the exercise device. Upstanding front support members 21 are fixed to the front end 15 of base 18. A hollow pulley guide 20 is provided in member 18. Pulley guide 20 extends longitudinally from in front of front end 15 of base 18 to slightly beyond the back end 17 of base 18, as shown in FIG. 1. Shroud 12 is fixed to the front end 15 of pulley guide 20 and to upstanding front support members 21.

Figure 2:
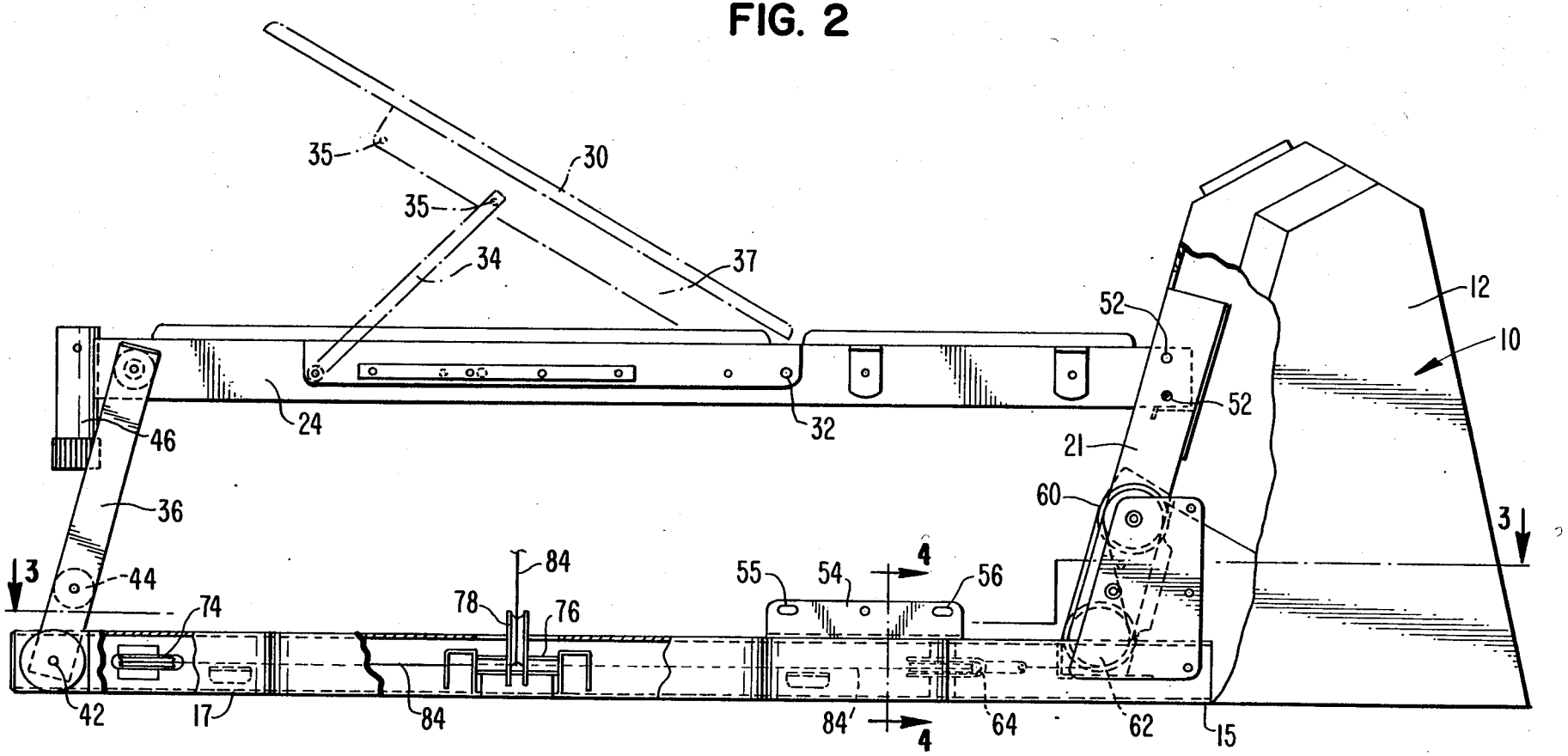
FIG. 2 is a side elevational view of the exercise device.

A bench, shown generally in FIG. 1 at 22, is provided for supporting a user of the exercise device. Preferably bench 22 includes a bench frame member 24 which extends longitudinally beneath bench pads 26. Preferably, bench 22 includes a first part 28 and a second part 30. First part 28 is fixed to bench frame member 24, whereas, second part 30 is pivotally connected to bench frame member 24, as shown in dotted outline in FIG. 1, so that second part 30 may be angled upwardly with respect to bench frame member 24. The pivotal connection between second part 30 and bench frame member 24 may be of conventional design. As shown, second part 30 is pivotally connected to bench frame member at 32 (FIG. 2). A support bracket 34 is provided to support second part 30 in its angled position. Bracket 34 may be pinned or otherwise connected to one of a plurality of holes 35 in frame member 37 of second part 30 of bench 22 in order to vary the angle of inclination of bench part 30.

Bench 22 includes pivot support legs 36 pivotally connected to the back end of bench 22. As shown in FIG. 1, pivot support legs 36 are pivotally pinned at 38 to a spacer 40 connected to bench frame leg 24. Pivot support legs 36 are also pivotally connected to pulley guide 20. A pivot pin 42 pivotally connects pivot support legs 36 to pulley guide 20. A roller 44 is positioned between pivot support legs 36.

A support foot 46 is fixed to the back end of bench frame member 24. Support foot 46 is a tube having an open top end 48 and a closed bottom end 50. When bench 22 is in the position shown in FIGS. 1 and 7, an exercise accessory unit, such as a leg lift accessory or a preacher curl accessory (not shown), may be fitted in the open end 48 of support foot 46 to expand even further the number of exercsies which can be performed. When bench 22 is in its lowered position, as shown in FIG. 8, support foot 46 engages the floor and supports the back end of bench 22.

Bench 22 may be positioned either in a first, raised position, shown in FIGS. 1 and 2, where bench 22 is parallel to and raised above base 18. In this position, bench frame member 24 is removably connected to upstanding frame supports 21 as shown at 52 (FIG. 2). Bench 22 may be lowered so that it is still parallel to but also proximate to base 18, as shown in FIG. 8. In order to lower bench 22, the front end of bench frame 24 is removed from its connection at 52 and bench 22 is pivoted about pivot points 42 and 38 until it is in its lowermost position. In this position the front end of bench frame 24 is removably connected to a first position 55 on bench support bracket 54 fixed to base frame member 20. When bench 22 is in its lowered position, as shown in FIG. 8, support foot 46 engages the floor to provide added support for the back end of bench 22.

Figure 7:
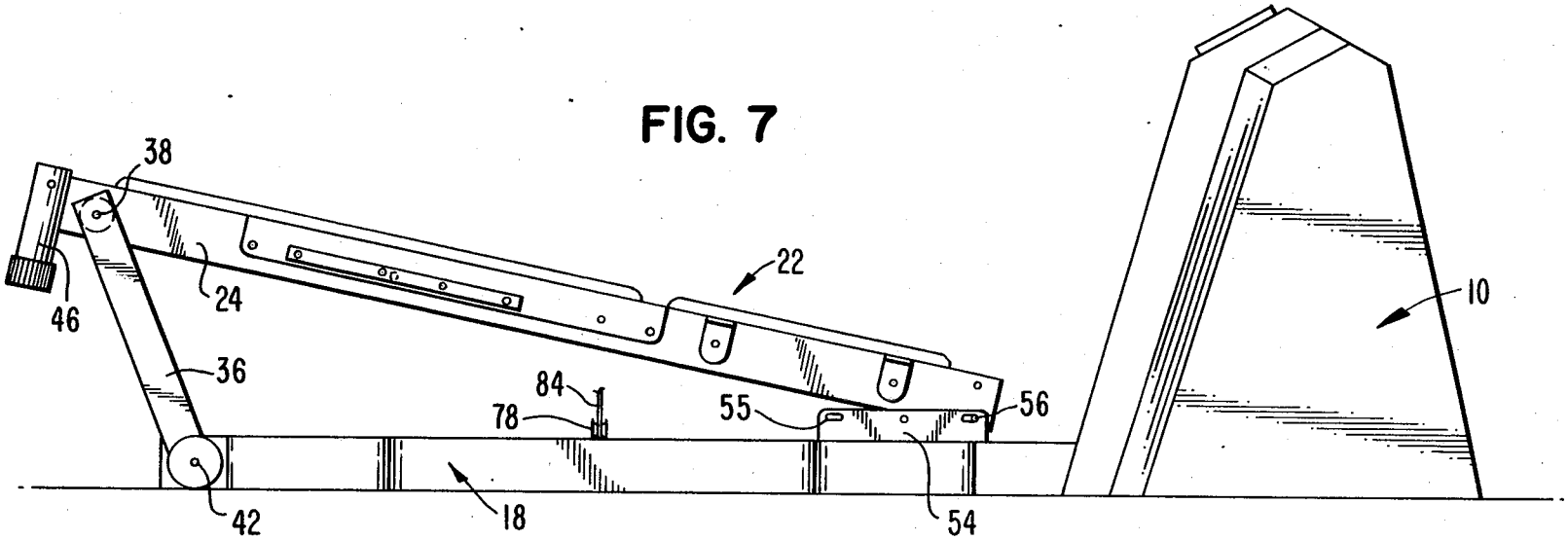
FIG. 7 is a side elevation view of the exercise device with the bench in an inclined configuration.
Figure 8:
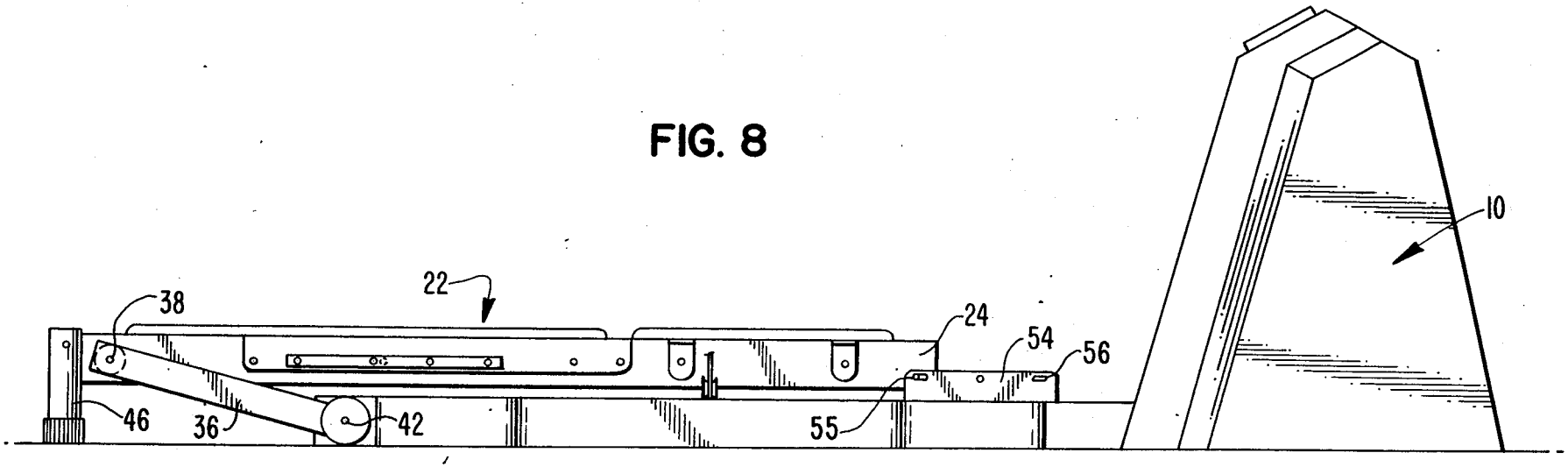
FIG. 8 is a side elevation view of the exercise device with the bench it its lowered position.

Bench 22 may be positioned in a third position, as shown in FIG. 7, in which the bench is declined forwardly towards variable resistance unit 10. In this configuration, the front end of bench frame member 24 is removably connected to a second position 56 in bracket 54.

The present invention includes a user engageable pulley system which allows the user to vary the exercises being performed. The pulley system includes a load cable 16 shown in FIG. 3 which is connected directly to variable resistance means 10. The pulley system may include pulleys 60 and 62, shown in FIG. 1 through which load cable 16 is trained. These pulleys are provided to lower the position at which load cable 16 exits from variable resistance means 10. It is desirable, for purposes which will hereinafter be explained, for load cable 16 to extend below the top surface of base 18. If load cable 16 were connected to variable resistance means 10 in a way which allowed cable load 16 to exit at the appropriate level, pulleys 60 and 62 would not be necessary. In the embodiment shown in FIG. 1, however, cable load 16 exists from an elevated position and thus it is necessary to use pulleys 60 and 62 to lower its position. As shown in FIGS. 2 and 3, one end of load cable 16 may be removably connected to a traveling pulley assembly 64. Traveling pulley assembly 64 includes a clevis 66 which is fixed to a traveling pulley block 68. A sheave or pulley wheel 70 is rotatably fixed within pulley block 68.

As stated above, pulley guide 20 is a hollow member. Traveling pulley assembly 64 is slidably supported within pulley guide 20 by a plurality of guide pads 72 which engage the inner walls of pulley guide 20 thus facilitating longitudinal sliding of pulley assembly 64. Preferably, guide pads 72 are made from nylon or a similar antifriction material.

Guide pulley asemblies 74 are positioned longitudinally spaced from traveling pulley assembly 64. As shown, guide pulley assemblies 74 are positioned near the back end of pulley guide 20 and proximate to its side wall. Additionally, second guide pulley assemblies 76 are provided longitudinally spaced between traveling assembly 64 and guide pulley assemblies 74. Additionally, pulley assemblies 76 are laterally spaced outwardly from pulley guide 20, as shown clearly in FIG. 3. Preferably, in order to provide for a compact base, pulley assemblies 64, 74 and 76 are horizontally oriented as shown in FIGS. 2 and 3, that is, the sheaves rotate in a plane parallel to the floor or base 18.

Additionally included in the pulley system are vertically oriented guide pulleys 78. Pulleys 78 are spaced laterally outwardly of pulleys 76. Pulleys 78 are vertically oriented, that is, the plan of rotation of the pulley wheel or sheave is perpendicular to the floor or base 18. Pulleys 78 are fixed within openings 80 in the top surface 82 of base 18. As shown clearly in FIG. 3, pulleys 78 are positioned on each side of base frame member 20 and thus on each side of bench 22. An exercise cable 84 is trained through pulleys 78, 76, 74, and 64 as shown in FIG. 3. The ends of exercise cable 84 extend upwardly through openings 80 in base 18, as shown clearly in FIG. 1.

An exercise bar 86 shown in FIG. 1 may be connected to the end of cable 84 or directly to load cable 16 for performing various exercises. Although a particular kind of exercise bar is illustrated in FIG. 1, it will be appreciated that the invention is not restricted to any particular kind of exercise bar. Moreover, the invention comprehends use with separate hand grips attached to each end of cable 84.

The use of the exercise device of the present invention will now be described. The user selects the position of the bench according to the particular exercise to be performed. For example, with the bench in its raised position, as shown in FIGS. 1 and 2 a conventional bench press may be readily performed. Numerous other exercises, as will be apparent to those of ordinarly skill in the art, can also be performed with the bench in this position. Additionally, in the raised position, an accessory unit, such as a leg lift or preacher curl accessory can be fitted within support foot 46 to expand the range of exercises which can be performed. When an accessory unit is used, exercise cable 84 will generally be trained over roller 44. Alternatively, the user may select the bench positions shown in FIGS. 7 and 8 for performing certain exercises. Next, according to the exercise to be performed and the position of the bench, the user selects whether the resistance will be lifted directly or indirectly. The resistance is lifted directly when the user directly engages an exercise bar or hand grip fixed to load cable 16. Alternatively, load cable 16 may be fixed to clevis 66 in which case the resistance will be moved indirectly by engaging a hand grip or exercise bar attached to the ends of exercise cable 84 and through the previously described pulley assemblies. In either configuration, the full amount of the resistance set will be lifted.

Although a preferred embodiment has been described, the invention is not to be limited thereto. Various modifications will be readily apparent to those of ordinary skill in the art, and the invention is defined and limited only by the following claims.

What is claimed is:

1. A floor-supported multiple exercise device comprising:

a floor-supported base having a platform with front and back ends and a pulley guide extending from said front end to said back end;

a bench assembly attached to said base for supporting a user of the exercise device, and including a bench disposed above said platform;

variable resistance means operatively connected to said base for providing a variable amount of exercising resistance through an extensible and retractable load cable emanating adjacent said front end of said platform;

a traveling pulley assembly connected to said load cable and longitudinally slidable within said pulley guide;

an exercise cable trained around said traveling pulley and extending through said pulley guide toward the back end of said platform;

cable guide means fixed to said floor-supported base for guiding said exercise cable from the back end of said platform upwardly on both sides of said bench, and at least one user-engageable handle selectively attached to the ends of said exercise cable or to said load cable.

2. An exercise device as recited in claim 1 wherein said traveling pulley assembly includes a plurality of guide pads adapted to engage said pulley guide thus facilitating longitudinal sliding of said traveling pulley assembly.

3. An exercise device as recited in claim 1 further comprising an attachment means for selectively attaching or detaching said traveling pulley assembly and said load cable.

4. An exercise device as recited in claim 1 wherein said cable guide means comprises at least one guide pulley assembly fixed to said base and longitudinally spaced from said traveling pulley assembly, said exercise cable trained from said traveling pulley assembly to said guide pulley assembly.

5. An exercise device as recited in claim 4 wherein said cable guide means further comprises at least one second guide pulley assembly fixed to said base and longitudinally positioned between said traveling pulley assembly and said guide pulley assembly and laterally spaced from said pulley guide in said base, said exercise cable trained from said traveling pulley assembly to said guide pulley assembly to said second guide pulley assembly.

6. An exercise device as recited in claim 5 wherein said cable guide means further comprises a vertically oriented guide pulley fixed to said base and positioned laterally outwardly of said second guide pulley assembly, said exercise cable trained from said travelling pulley assembly to said guide pulley assembly to said second guide pulley assembly to said vertically oriented guide pulley so that the ends of said exercise cable extend upwardly from said vertically oriented guide pulley.

7. A floor-supported multiple exercise device comprising:

a floor-supported base having a platform;

an adjustable bench assembly attached to said base for supporting a user of the exercise device above said platform, said bench assembly having a bench and adjustable bench support means for selectively setting the position of said bench between a first raised position wherein said bench is parallel to and spaced above said platform, a second lowered position wherein said bench is parallel to and proximate to said platform, and a third angled position wherein said bench is angled with respect to said platform;

variable resistance means operatively connected to said base for providing a variable amount of exercising resistance;

a traveling pulley assembly connected to said load cable and longitudinally slidable within said pulley guide;

an exercise cable trained around said traveling pulley and extending through said pulley guide toward the back end of said platform;

cable guide means fixed to said floor-supported base for guiding said exercise cable from the back end of said platform upwardly on both sides of said bench, and at least one user-engageable handle selectively attached to the ends of said exercise cable or to said load cable.

8. An exercise device as recited in claim 7 wherein said bench and said platform having front and back ends, said base has an upstanding front support adjacent the front end of said platform, the front end of said bench is fixed to said front support when said bench is in said first raised position, and the front end of said bench is fixed to said base adjacent said platform when said bench is in said lowered or inclined positions.

9. An exercise device as recited in claim 8 wherein said adjustble bench support means comprises a support leg pivotally connected at one of its ends the back end of said bench and pivotally connected at its other end to said base adjacent the rear end of said platform.

10. An exercise device as recited in claim 9 wherein said adjustable bench support means further comprises a support foot fixed to said back end of said bench, said support foot adapted to engage the floor when said bench is in said second lowered position.

11. An exercise device as recited in claim 10 wherein said support foot comprises accessory means for attaching an accessory exercise device to said support foot.

12. An exercise device as recited in claim 15 wherein said traveling pulley assembly includes a plurality of guide pads adapted to engage said pulley guide thus facilitating longitudinal sliding of said traveling pulley assembly.

13. An exercise device as recited in claim 7 further comprising attachment means for selectively attaching or detaching said traveling pulley and said load cable.

14. An exercise device as recited in claim 7 wherein said cable guide means comprises at least one guide pulley assembly fixed to said base and longitudinally spaced from said traveling pulley assembly, said exercise cable trained from said traveling pulley assembly to said guide pulley assembly.

15. An exercise device as recited in claim 14 wherein said cable guide means further comprises at least one second guide pulley assembly fixed to said base and longitudinally positioned between said traveling pulley assembly and said guide pulley assembly and laterally spaced from said pulley guide in said base, said exercise cable trained from said traveling pulley assembly to said guide pulley assembly to said second guide pulley assembly.

16. An exercise device as recited in claim 15 wherein said cable guide means further comprises a vertically oriented guide pulley fixed to said base and positioned laterally outwardly of said second guide pulley assembly, said exercise cable trained from said traveling pulley assembly to said guide pulley assembly to said second guide pulley assembly to said vertically oriented guide pulley so that the ends of said exercise cable extend upwardly from said vertically oriented guide pulley.

* * * * *